US006524199B2

(12) United States Patent
Goldman

(10) Patent No.: US 6,524,199 B2
(45) Date of Patent: Feb. 25, 2003

(54) SYSTEM FOR LOCATING A GOLF BALL

(75) Inventor: Cheryl Goldman, 1 Mark Ct., Huntington, NY (US) 11743

(73) Assignee: Cheryl Goldman, Melville, NY (US)

( * ) Notice: Subject to any disclaimer, the term of this patent is extended or adjusted under 35 U.S.C. 154(b) by 0 days.

(21) Appl. No.: 09/768,600

(22) Filed: Jan. 25, 2001

(65) Prior Publication Data

US 2002/0098913 A1 Jul. 25, 2002

(51) Int. Cl.[7] ..... A63B 43/06
(52) U.S. Cl. ..... 473/353; 342/450
(58) Field of Search ..... 473/131, 353, 473/407, 409; 342/450, 451, 458, 463, 419, 352, 357.06, 357.08, 357.12, 357.17; 340/539, 571, 572.1, 825.36

(56) References Cited

U.S. PATENT DOCUMENTS 5,469,175 A * 11/1995 Boman ..... 342/357.08
5,686,891 A * 11/1997 Sacca et al. ..... 340/571
5,772,534 A * 6/1998 Dudley ..... 473/407
6,011,466 A * 1/2000 Goldman ..... 340/539
6,113,504 A * 9/2000 Kuesters ..... 473/353

* cited by examiner

*Primary Examiner*—Joe H. Cheng
*Assistant Examiner*—K. Nguyen

(57) ABSTRACT

A system for locating a golf ball on a golf course by a golfer using a golf cart. The system includes a signal generator, a microchip, and an amplifier. The signal generator is connected to a portable computer on the golf cart and generates a first signal. The microchip is disposed in the golf ball and receives the first signal and generates a second signal in response thereto that is received by a base computer which triangulates the location of the golf ball off the locations of fixed objects on the golf course and generates a third signal in response thereto that is received by the portable computer which displays the location of the golf ball relative to the location of the golf cart already displayed. The amplifier is operatively connected to the portable computer and receives and amplifies the second signal that is to be received by the base computer.

1 Claim, 5 Drawing Sheets

SYSTEM FOR LOCATING A GOLF BALL

BACKGROUND OF THE INVENTION

1. Field of the Invention

The present invention relates to a system. More particularly, the present invention relates to a system for locating a golf ball.

2. Description of the Prior Art

Numerous innovations for object locating devices have been provided in the prior art that will be described. Even though these innovations may be suitable for the specific individual purposes to which they address, however, they differ from the present invention.

For example, U.S. Pat. No. Des. 391,508 to Lucas teaches the ornamental design for a combined transmitter and receiver for locating lost keys.

Another example, U.S. Pat. No. 3,782,730 to Horchler teaches an electronic golf ball comprising a central resilient sphere, a mass of elastic material surrounding the sphere and an outer casing, the central sphere including an electric squegging oscillator circuit, a battery therefor and a transmitting coil, all enclosed in a spherical mass of a set resin which forms a solid core, the spherical mass being located with close fit in a hollow spherical cavity formed in the central resilient sphere. The battery is a mercury cell located within the transmitting coil, as are the other components of the squegging oscillator circuit. The electrical circuit may include components which permit the oscillator to be turned on and off when the golf ball is brought into, and then moved out of, an A.C. magnetic field having a predetermined frequency.

Still another example, U.S. Pat. No. 4,101,873 to Anderson et al. teaches miniaturized coded transmitter and battery powered receivers that are electively responsive to a predetermined code transmission and are provided with a miniaturized audible signal generator in each receiver such that the receiver, when interrogated by a proper signal, will respond audibly. By placing such receivers on commonly used objects such as eyeglasses, purses, and other personal articles, audible location of these articles is accomplished by interrogating each object with a corresponding coded signal and following the audible response from the object to the position of the object to locate the latter. The duty cycle of the receiver is very short and recurrent over intervals less than the known energization interval of the transmitter to insure reception, but materially minimize the power consumption of the receivers.

Yet another example, U.S. Pat. No. 4,507,653 to Bayer teaches a miniature, battery-operated electronic unit adapted to be attached to a common article, such as keys or eyeglasses. The unit is responsive to a plurality of sounds for emitting audible tones to enable a misplaced article to be located. A sound detecting and indicating circuit provides the audible tones upon receipt of a sequence of sounds falling within predetermined frequency, time spacing, and amplitude ranges. The correct sequence of sounds is generated by the user by clapping, whistling, or making any other loud sounds, and no additional transmitting device is required. Improper sequences of sounds are prevented from producing false activation of the unit. Extremely low power consumption, resulting in part from CMOS technology, allows the unit to remain on continuously for a period of six to nine months using standard camera (button cell) batteries. Special battery-saver circuitry prolongs battery life. The unit can be fabricated using gate array or custom chip technology, which results in extremely small size and low cost of manufacture. A visual indicator allows the user to learn proper operation.

Still yet example, U.S. Pat. No. 5,423,549 to Englmeier teaches a device with a signal receiving unit for locating golf balls. Each golf ball is associated with a transmitting unit and the signals emitted by each transmitting unit are detected by the signal receiving unit. The transmitting unit is associated with an energy store as an operating voltage source. The device includes a charging circuit with an energy transmitter for wireless transmission of the electrical energy to an energy receiver connected in front of the energy store. Immediately after the charging phase of the energy store, the transmitting unit starts sending transmission signals and in so doing discharges the energy store. The transmitted signals received by the signal receiving unit are fed to an evaluation circuit which produces an output signal for locating the golf ball. This output signal is then fed to a display unit. After a certain discharge time, the transmitting unit stops transmitting the transmission signals. The golf ball is located only during this limited transmission time. Golf balls which have been mishit can be located rapidly and simply using the device.

Yet still example, U.S. Pat. No. 5,434,789 to Fraker et al. teaches a GPS golf diagnostic system for receiving radio signals from earth orbiting GPS satellites, determining the latitudinal, longitudinal and altitudinal coordinates of the diagnostic system, and computing the distance between these coordinates and a plurality of known positions. The diagnostic system of the present invention utilizes the computed data for informing the user of the distance between the present position of the golf ball and known positions such as previous ball position, green location and pin position. The diagnostic system is further useful for keeping track of shot distances, clubs used, scores obtained on each hole and total game scores for a plurality of courses.

Still yet example, U.S. Pat. No. 5,447,314 to Yamazaki et al. teaches a sound emitting golf ball for locating a golf ball after it is struck by a golf club. The system comprises a miniaturized electronic, battery powered piezoelectric sound generator surrounded, by a shock absorber that is embedded inside a golf ball. The sound generating system is constructed with very small, inexpensive shock resistant components and embedded at the center of the golf ball, inside the shock absorber. The system can be designed to operate in the audible or ultrasonic range.

Yet still example, U.S. Pat. No. 5,564,698 to Honey et al. teaches a hockey puck with an electromagnetic transmitter. The electromagnetic transmitter could include an infrared transmitter, ultraviolet transmitter, radar repeater, RF transmitter or other device for transmitting electromagnetic waves outside of the visible spectrum. The electromagnetic transmitter is turned on using a shock sensor and is turned off using a timer.

Still yet example, U.S. Pat. No. 5,626,531 to Little teaches golf balls that have a passive tag at selected capacitance inserted within their interior to enable detection of the presence of the tag, and of the ball, using an electronic detecting system. The tags are passive, being energized into emitting a signal by the presence of a detector field of predetermined characteristics such that the tag generates a responsive signal, which can be detected by an adjacent detector circuit, to signal the presence of a tagged ball. One field of use is for driving ranges, where the unauthorized removal of range balls constitutes an unacceptable loss for the proprietors of the establishment. The system also lends itself to finding lost balls, using a hand-portable detector, and to use with other types of game ball.

Yet still example, U.S. Pat. No. 5,686,891 to Sacca et al. teaches a system for locating an object. The system includes an electronic device, a wireless transmitter for outputting a transmitted signal, and a receiver wherein one of the receiver and the transmitter is mounted within the electronic device and the other is positioned remote therefrom. The receiver comprises a wake up timer circuit for periodically generating a wake up signal, a wireless signal receiver being activated by the receipt of the wake up signal from the wake up timer circuit for generating a detect signal when the wireless signal receiver circuit receives the transmitted signal from the transmitter, and an audible signal generator circuit for generating an audible signal upon receipt of the detect signal from the wireless signal receiver circuit. The wake up timer circuit and the wireless signal receiver circuit are disabled when the audible signal generator circuit generates the audible signal.

Still yet example, U.S. Pat. No. 5,772,534 to Dudley teaches a golf information system which provides for automatic detection of a golf cart position on a golf course by either a golfer on the cart or personnel in a golf course clubhouse. In one embodiment, a differential global positioning satellite receiver (DGPS) is utilized to detect a golf cart position and the detected position is compared with a digital data map where it is further transmitted to a golf cart display as well as to a clubhouse display, either automatically in a timed manner, or upon prompting by a golfer or clubhouse personnel. The system can be further used to send speed of play messages to a golfer from a clubhouse in order to speed up play, and can also be used to send emergency and acknowledgment signals from a golfer to a clubhouse in response to emergencies or messages displayed to the golfer. Furthermore, advertizing messages can be displayed to a golfer from a clubhouse in response to clubhouse initiated signaling.

A typical application of the prior art system 10 of Dudley for locating a golf cart 12 on a golf course 14 by a golfer hitting a golf ball 16 can best be seen in FIG. 1, which is a block diagram of a typical prior art system for locating a golf cart, and as such, will be discussed with reference thereto.

The golf course 14 has fixed objects 18 with locations and a base computer 20, which is preferably located in a club house 22, and which reads and triangulates the locations of the fixed objects 18, via a GPS 24.

The golf cart 12 has a location and a portable computer 26 that is linked by radio communication to the base computer 20 and which is in communication with the GPS 24.

The portable computer 26 has a display 28 that displays the locations of the fixed objects 18 from the base computer 20.

The base computer 20 determines the location of the golf cart 12 relative to the locations of the fixed objects 18 already determined and relays the location of the golf cart 12 back to the portable computer 26 which displays on the display 28 the location of the golf cart 12 relative to the fixed objects 18 already displayed thereon.

Yet still example, U.S. Pat. No. 5,873,797 to Garn teaches a method and system for obtaining accurate measurements of distance of a golf ball from features of interest on a hole of a golf course including tee boxes, cups, water hazards, sand traps, rough areas adjacent fairway, and cart path, uses a golf cart equipped with a computerized navigation system including a display monitor. Survey data for the course are stored in the navigation system database as part of a map of so that fixed positions of at least some of the features of the course, including the cart path and outline of the hole of the computerized navigation system, can be selectively displayed in the map or portion thereof on the cart monitor screen during play of the course. The navigation system has a capability to detect and indicate the real time position of the golf cart as an icon on the course map displayed on the monitor screen, and has, in its database, a ball icon line approximating the longitudinal center-line of the hole. A ball icon is established distinct from the cart icon for display in the map on the monitor screen, and is arranged to move along the ball icon line in unison with movement of the cart icon along the cart path. Distance measurements are enabled and displayed from the ball icon to features on the map when the features are respectively selected by a pointer on the monitor display. A positioning device is provided to move the ball icon from the ball icon line to approximate the position of a ball in play on the hole to measure distance to a selected feature.

Still yet example, is a sealed golf ball with remotely activated audible sound generator powered by an electromagnetically rechargeable battery taught by my U.S. Pat. No. 6,011,466.

The configuration of my prior art sealed golf ball 50 taught by my U.S. Pat. No. 6,011,466 can best be seen in FIG. 1A, which is a diagrammatic side elevational view of my prior art sealed golf ball, and as such, will be discussed with reference thereto.

The sealed golf ball 50 includes a shock absorber 52 that is contained in the golf ball 50.

The sealed golf ball 50 further includes a coil-shaped miniature receiver antenna 45 that is contained in the golf ball 50 and receives a first signal 56.

The sealed golf ball 50 further includes a miniature wireless receiver 58 that is contained in the golf ball 50, is in electrical communication with, and receives the first signal 56 from, the coil-shaped miniature receiver antenna 54, and generates a second signal 60 in response thereto.

The sealed golf ball 50 further includes an audible acoustic generator 62 that is contained in the golf ball 50, is in electrical communication with the miniature wireless receiver 58, receives the second signal 60 from the miniature wireless receiver 58, and generates a series of audible beeps 64 through the golf ball 50 and out into the ambient 66 for hearing by a person seeking the golf ball 50.

The sealed golf ball 50 further includes a rechargeable micro-battery 68 that is contained in the golf ball 50 and is in electrical communication with, and powers, the miniature wireless receiver 58 and the audible acoustic generator 62.

The sealed golf ball 50 further includes a transmitter housing 70 for carrying by the person seeking to locate the golf ball 50.

The sealed golf ball 50 further includes a wireless transmitter 72 that is contained in the transmitter housing 70 and selectively generates the first signal 56.

The sealed golf ball 50 further includes a transmitter antenna 74 that is disposed on the transmitter housing 70, is in electrical communication with the wireless transmitter 72, and transmits the first signal 56.

The sealed golf ball 50 further includes a switch 76 that is disposed on the transmitter housing 70 and is in electrical communication with the wireless transmitter 72, and when activated, causes the wireless transmitter 72 to generate the first signal 56 and the transmitter antenna 74 to transmit the first signal 56, which is received by the coil-shaped miniature receiver antenna 54, which sends the first signal 56 to the miniature wireless receiver 58, which sends the second signal 60 to the audible acoustic generator 62, which generates the series of audible beeps 64, which provides an audible trail to the golf ball 50 to be located.

It is apparent that numerous innovations for object locating devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, An Object of the present invention is to provide a system for locating a golf ball that avoids the disadvantages of the prior art.

Another object of the present invention is to provide a system for locating a golf ball that is simple to manufacture.

Still another object of the present invention is to provide a system for locating a golf ball that is simple to use.

Briefly seated, yet another object of the present invention is to provide a system for locating a golf ball on a golf course by a golfer using a golf cart. The system includes a signal generator, a microchip, and an amplifier. The signal generator is connected to a portable computer on the golf cart and generates a first signal. The microchip is disposed in the golf ball and receives the first signal and generates a second signal in response thereto that is received by a base computer which triangulates the location of the golf ball off the locations of fixed objects on the golf course and generates a third signal in response thereto that is received by the portable computer which displays the location of the golf ball relative to the location of the golf cart already displayed. The amplifier is operatively connected to the portable computer and receives and amplifies the second signal that is to be received by the base computer.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Prior Art

Figure 1:
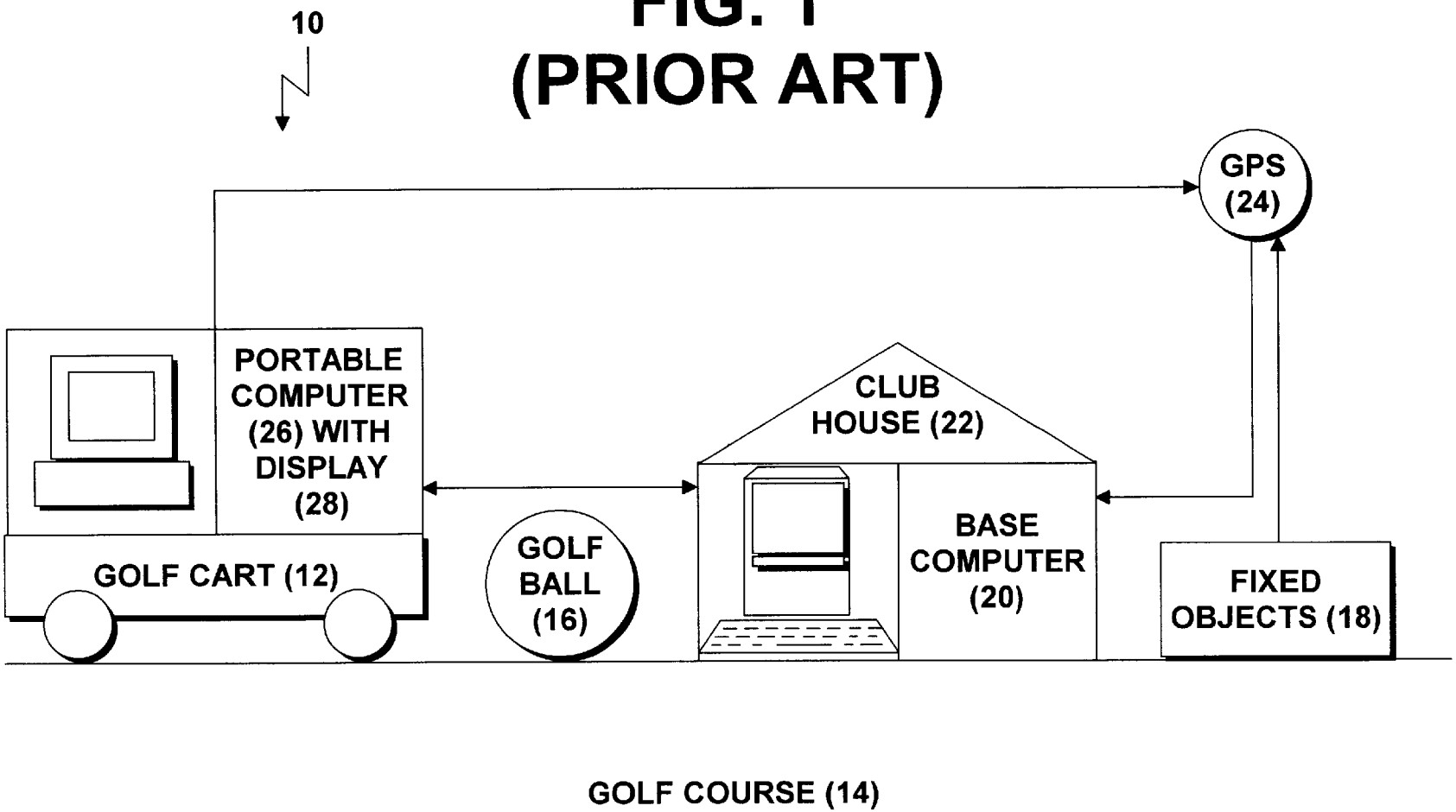
FIG. 1 (PRIOR ART)
FIG. 1 is a block diagram of a typical prior art system for locating a golf cart.
Figure 1A:
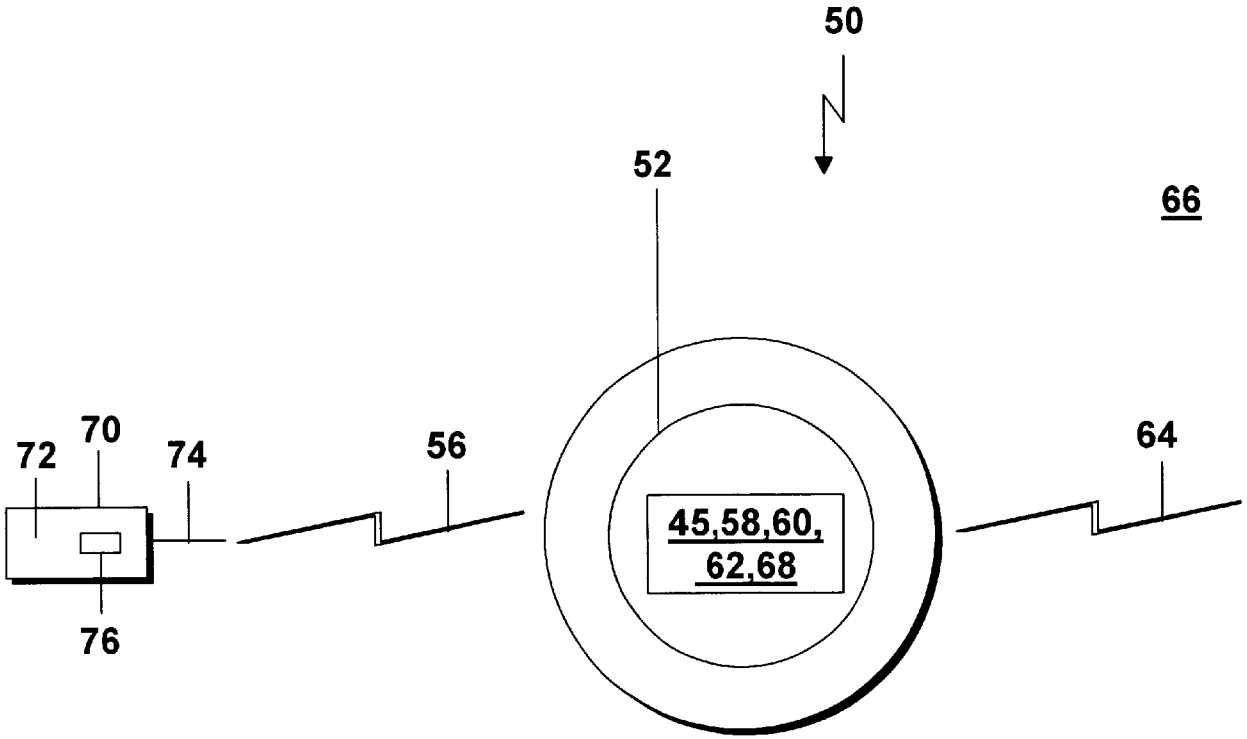
FIG. 1A (PRIOR ART)
FIG. 1A is a diagrammatic side elevational view of my prior art sealed golf ball.

10 system for locating golf cart 12 on golf course 14 by golfer hitting golf ball 16
12 golf cart on golf course 14
14 golf course
18 fixed objects on golf course 14
20 base computer of golf course 14 preferably located in club house 22 on golf course 14
22 club house on golf course 14
24 GPS
26 portable computer on golf cart 12 on golf course 14
28 display of portable computer 26 on golf cart 12 on golf course 14
50 sealed golf ball
52 shock absorber
54 coil-shaped miniature receiver antenna
56 first signal
58 miniature wireless receiver
60 second signal
62 audible acoustic generator
64 series of audible beeps for hearing by person seeking sealed golf ball 50
68 rechargeable micro-battery
70 transmitter housing for carrying by person seeking to locate sealed golf ball 50
72 wireless transmitter
74 transmitter antenna
76 switch

First Embodiment of Present Invention

30 system of present invention for locating golf ball 32
32 golf ball
34 signal generator for operatively connecting to portable computer 26 generating first signal 36 when activated
36 first signal generated when signal generator 34 is activated
38 microchip
40 second signal generated by microchip 38 for receiving by base computer 20
42 third signal generated by base computer 20 for receiving by portable computer 26
44 amplifier for operatively connecting to portable computer 26

Second Embodiment of Present Invention

80 improved sealed golf ball of present invention
82 conventional cellular telephone
84 microchip

DETAILED DESCRIPTION OF THE PREFERRED EMBODIMENT

Figure 2:
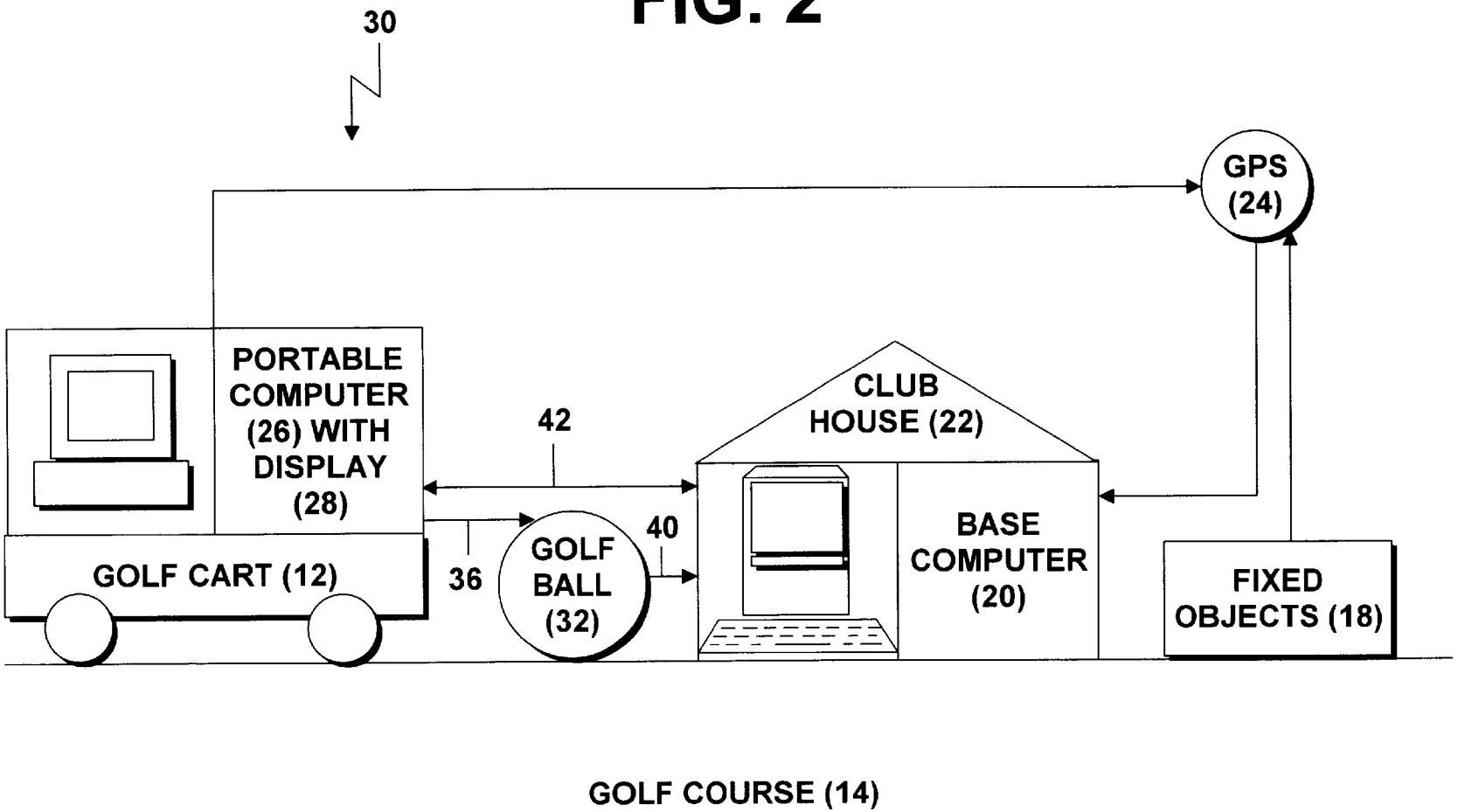
FIG. 2 is a block diagram of a first embodiment of the present invention in use.

Referring now to the figures, in which like numerals indicate like parts, and particularly to FIG. 2, which is a block diagram of the present invention in use, a first embodiment of the system of the present invention is shown generally at 30 for locating a golf ball 32.

Figure 3:
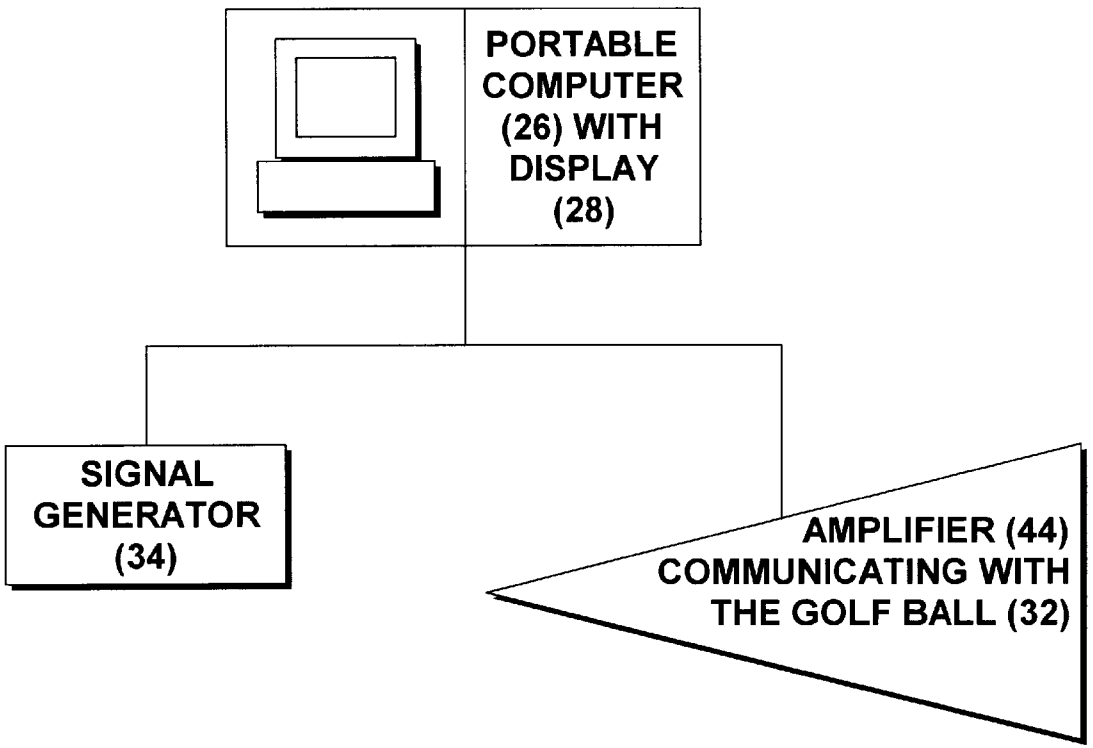
FIG. 3 is a block diagram of the portable computer with display of the first embodiment of the present invention.
Figure 4:
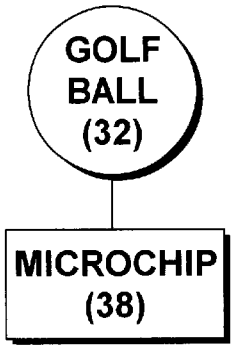
FIG. 4 is a block diagram of the golf ball of the first embodiment of the present invention.

The configuration of the system 30 can best be seen in FIGS. 2–4, which are, respectively, again a block diagram of the present invention in use, a block diagram of the portable computer with display of the present invention, and a block diagram of the golf ball of the present invention, and as such, will be discussed with reference thereto.

The system 30 comprises a signal generator 34 for operatively connecting to the portable computer 26, and which generates a first signal 36 when activated.

The system 30 further comprises a microchip 38 that is disposed in the golf ball 32 and receives the first signal 36 from the signal generator 34 and generates a second signal 40 in response thereto for receiving by the base computer 20 which triangulated the location of the golf ball 32 off the locations of the fixed objects 18 and generates a third signal 42 in response thereto for receiving by the portable computer 26 which displays on the display 28 thereof the location of the golf ball 32 relative to the location of the golf cart 12 already displayed on the display 28 thereof so as to allow the golfer to locate the golf ball 32.

The system 30 further comprises an amplifier 44 for operatively connecting to the portable computer 26, and which receives and amplifies the second signal 40 from the microchip 38 for receiving by the base computer 20.

A second embodiment of the present invention is an improvement upon my U.S. Pat. No. 6,011,466 discussed in the BACKGROUND OF THE INVENTION supra.

Figure 5:
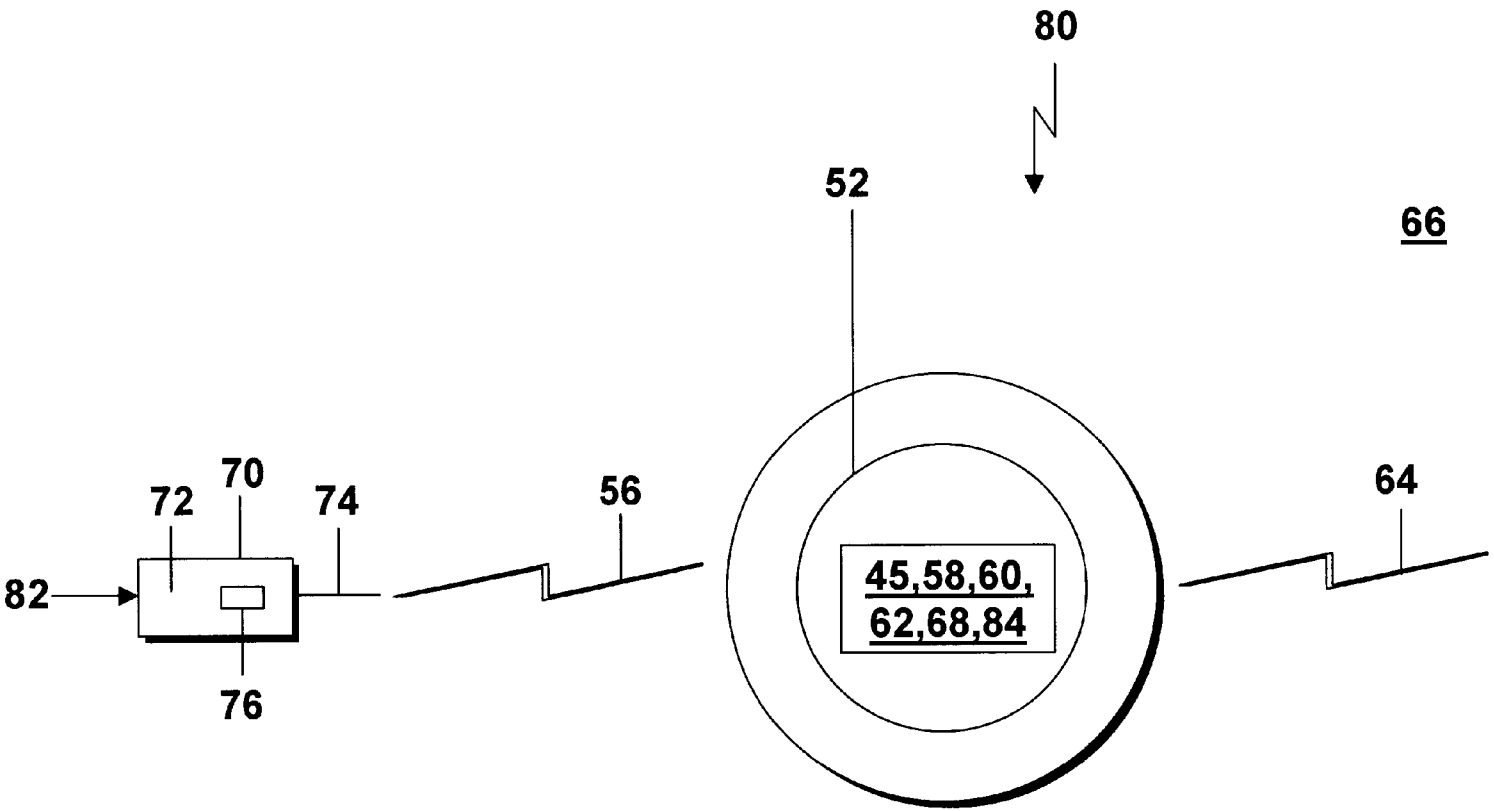
FIG. 5 is a diagrammatic side elevational view of a second embodiment of the present invention.

The improved sealed golf ball 80 can best be seen in FIG. 5, which is a diagrammatic side elevational view of a second embodiment of the present invention, and as such, will be discussed with reference thereto.

The improvement comprises the transmitter housing 70, the wireless transmitter 72, and the transmitter antenna 74 being a conventional cellular telephone 82.

The improvement further comprises a microchip 84 for being powered by the rechargeable micro-battery 68, for disposing in the golf ball 80, and for activating the audible acoustic generator 62 when the conventional cellular telephone 82 is activated and a preset code is entered therein.

It will be understood that each of the elements described above, or two or more together, may also find a useful application in other types of constructions differing from the types described above.

While the invention has been illustrated and described as embodied in a system for locating a golf ball, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A system for locating a golf ball on a golf course by a golfer using a golf cart, wherein the golf course has fixed objects with locations and a base computer that reads and triangulates the locations of the fixed objects via a GPS, wherein the golf cart has a location and a portable computer that is linked by radio communication to the base computer, wherein the golf cart is in communication with the GPS and has a display that displays the locations of the fixed objects from the base computer, and wherein the golf cart and the base computer are linked to the GPS to allow the base computer to determine the location of the golf cart relative to the locations of the fixed objects already determined and relay the location of the golf cart back to the portable computer that displays to the golfer on the display the location of the golf cart relative to the fixed objects already displayed thereon, said system comprising:

a) a signal generator for operatively connecting to the portable computer, and generating a first signal when activated;

b) a microchip disposed in the golf ball and receiving said first signal from said signal generator and generating a second signal in response thereto for receiving by the base computer which triangulates the location of the golf ball off the locations of the fixed objects and generates a third signal in response thereto for receiving by the portable computer which displays on the display thereof the location of the golf ball relative to the location of the golf cart already displayed on the display thereof so as to allow the golfer to locate the golf ball; and c) an amplifier for operatively connecting to the base computer, and receiving and amplifying said second signal from said microchip for receiving by the base computer.

* * * * *